United States Patent [19]

Kawanishi et al.

[11] Patent Number: 4,640,880

[45] Date of Patent: Feb. 3, 1987

[54] ELECTROPHOTOGRAPHIC PROCESS WITH MAGNETIC BRUSH DEVELOPMENT USING SEMICONDUCTIVE FERRITE CARRIERS

[75] Inventors: Tsuneaki Kawanishi; Yasuki Mori, both of Hitachi; Koji Noguchi, Fukiage; Tsutomu Iimura, Tachikawa, all of Japan

[73] Assignees: Hitachi Metals Co., Ltd.; Hitachi, Ltd., both of Tokyo, Japan

[21] Appl. No.: 668,877

[22] PCT Filed: Mar. 28, 1984

[86] PCT No.: PCT/JP84/00142

§ 371 Date: Oct. 24, 1984

§ 102(e) Date: Oct. 24, 1984

[87] PCT Pub. No.: WO84/03955

PCT Pub. Date: Oct. 11, 1984

[30] Foreign Application Priority Data

Apr. 1, 1983 [JP] Japan ..... 58-55124

[51] Int. Cl.[4] ..... G03G 9/14

[52] U.S. Cl. ..... 430/106.6; 430/122; 430/137; 118/657

[58] Field of Search ..... 430/106.6, 107, 108, 430/122, 137; 118/657, 658

[56] References Cited

U.S. PATENT DOCUMENTS

| | | | |
|---|---|---|---|
| 4,199,356 | 4/1980 | Matsumoto et al. | 430/122 |
| 4,284,702 | 8/1981 | Tabuchi et al. | 430/122 |
| 4,336,318 | 6/1982 | Fukumoto et al. | 430/122 |

*Primary Examiner*—John L. Goodrow

*Attorney, Agent, or Firm*—Antonelli, Terry & Wands

[57] ABSTRACT

In a method of developing triboelectric magnetic toner, an electrostatic latent image is formed on a substance, the latent image is developed by a magnetic brush method using a ferrite carrier of semiconductivity and a triboelectric magnetic tonor, and the developed toner image is transferred to a transfer member and fixed.

By adding the semiconductive ferrite carrier, a lump of tonor is broken with a mechanical force of the carrier so as to increase the flowability of the tonor and to prevent the agglomeration of the tonor due to dielectric charging.

14 Claims, 3 Drawing Figures

ELECTROPHOTOGRAPHIC PROCESS WITH MAGNETIC BRUSH DEVELOPMENT USING SEMICONDUCTIVE FERRITE CARRIERS

FIELD OF THE INVENTION

The present invention relates to a method of electrophotography and, more particularly, to a method of electrophotography in which an electrostatic latent image is developed with triboelectric magnetic toner with a chargeability by a magnetic brush method and in which the developed image is then transferred to a transfer member such as ordinary paper and is thereafter fixed to prepare a copy.

BACKGROUND OF THE INVENTION

The method of electrophotography prepares a copy by forming an electrostatic latent image on the photoconductive surface of a photosensitive member, by developing the electrostatic latent image to form a toner image, and by fixing the toner image either directly or after the toner image has been transferred to a transfer member. In case the electrostatic latent image is to be developed, a magnetic brush developing method is usually conducted, in which case a two-component system developer, which is a mixed powder comprising a non-magnetic toner and a carrier such as iron powder is used as a developing agent. When using this magnetic brush developing method with the two-component system developer, the carriers and the toner are mixed in a predetermined ratio and are frictionally charged so that the toner is charged with a predetermined polarity until it sticks to the surface where the electrostatic latent image is formed. Therefore, the magnetic brush developing method has the advantage that the transfer is feasible. However, the magnetic brush developing method requires means for mixing and frictionally charging the toner and the carriers to a satisfactory extent. Since only the toner is consumed during the development, moreover, the developing method requires the so-called "toner control device", i.e., a toner concentration monitoring device for maintaining a uniform toner concentration. As a result, the developing device needs to be bigger and have a more complicated construction. Moreover, since the carriers become exhausted after extended periods of time, the developing method has the problem that it is necessary to replace the carriers.

The developer, therefore, that has been used in recent years is a one-component system non-chargeable magnetic toner which is comprised essentially of magnetic powder and resin. A developing method using that magnetic toner, has been a method which is disclosed in Japanese Patent Publication No. 56-2705. The developing method disclosed selectively deposit toner on the surface of the electrostatic latent image by using as magnetic toner the conductive and magnetic toner which has an electric resistance of about $10^4$ to $10^{11}$ $\Omega$·cm when an electric field of a direct current of 100 V/cm is applied, by forming a magnetic toner carrier of a conductive sleeve, by electrically coupling the back of an electrostatic latent image carrier and the conductive sleeve thereby to form a electrically conductive path through the conductive and magnetic toner layer between the surface of the electrostatic latent image carrier and the conductive sleeve, by collecting at the leading end of a toner brush the charges which have a polarity opposite to that of the electrostatic latent image induced on the conductive sleeve by the charges of the electrostatic latent image, and by relatively moving the conductive sleeve and the electrostatic latent image carrier so that the coulomb force generated between the charges at the leading end of the toner brush and the charges of the electrostatic latent image may overcome the magnetic attraction generated by a permanent magnet roll disposed inside of the conductive sleeve.

The developing method thus disclosed can be applied to the so-called "CPC method", by which the toner image obtained by the development is fixed to directly prepare a copy, because the toner used has conductivity. However, the method intrinsically desired is not the aforementioned CPC method for a direct record but for an indirect record, i.e., the so-called "PPC method", by which a photosensitive member acting as a master is repeatedly used for development so that the developed toner image can be transferred to ordinary paper having a low electric resistance.

If the aforementioned developing method is applied to the PPC method, the development is satisfactorily conducted because the electric resistance of the toner is low, but toner splash and reduction of the transfer electric field due to leakage take place at the transferring step to make the transferred image obscure. This raises the difficulty that it is difficult to apply the magnetic toner in the PPC method.

In order to overcome the difficulty in transfer, a method has been proposed in which the development is conducted by using insulating magnetic toner having a higher electric resistance than the magnetic toner and with which the transfer is then conducted. According to the method proposed, a device is required for raising the developing efficiency of the toner because the developability generally becomes worse as the electric resistance of the magnetic toner becomes higher. As the device therefor, there is disclosed in Japanese Patent Laid-Open No. 53-129639, for example, a method in which the sleeve of a developing device is rotated to restrict the velocity difference between the sleeve and a photosensitive member to within a predetermined range thereby enhancing the developing efficiency. In the method disclosed in Japanese Patent Laid-Open No. 53-31136, on the other hand, the intent is to enhance the developability of the insulating magnetic toner by improving the aforementioned sleeve rotating system to increase the moving velocity of the toner. More specifically, the method disclosed affects the development by using insulating magnetic toner having an electric resistance not lower than $10^{12}\Omega$·cm when an electric field of a direct current of 10,000 V/cm is applied, by adhering the conductive particles to the surface of the toner within such a range as does not reduce the electric resistance, by bringing the toner and the electrode into electric contact through the high-speed rotations of the sleeve and/or the magnet roll thereby to charge the toner with conductive particles, and by moving the toner with conductive particles to the surface of the latent image at a high speed not lower than 10 cm/sec. In case the development is conducted by the disclosed method, however, the toner comes into contact with the latent image surface at a high speed. If the parting velocity of the toner from the latent image is increased, on the other hand, the toner charged by the electrode sticks to the latent image surface due to the coulomb force, but is recovered from the latent image surface because the cleaning effect of the magnetic brush becomes strong, thereby inviting a phenomenon where the developing efficiency is degraded. According to the disclosed method, moreover, in the case where the toner is moved by the rotation the sleeve only, the doctor section cannot uniformly regulate the toner and becomes liable to be clogged with a cluster of toner or dust thereby forming streaks from insufficient development due to shortage of the toner on the sleeve.

In order to eliminate those defects, therefore, there has been proposed in Japanese Patent Publication No. 57-12148 and Japanese Patent Laid-Open No. 55-126266 a method in which the moving velocity of the toner is not higher than 10 cm/sec and in which the sleeve and the magnet roll are rotated in an identical direction. According to the method disclosed, the deterioration of the toner movement on the sleeve is eliminated and the charging efficiency of the electrode is improved so that the insulating non-chargeable magnetic toner can be applied to the PPC method although it has been accepted as being difficult.

Thanks to the methods thus far described, the PPC method of the non-chargeable magnetic toner has reached practical application. However, the insulating non-chargeable magnetic toner generally cannot be charged even with the aforementioned development devices, and the surface potential of the photosensitive member has to be set to be higher than the ordinal level by several hundred volts in order that the toner may achieve the charge necessary for the development. In case the surface potential of the photosensitive member is to be dropped, on the other hand, a photosensitive zinc oxide having a short lifetime has to be used. In any case, therefore, the lifetime of the photosensitive member is shortened, which raises the running cost of the copies.

This leads to the proposal of triboelectric magnetic toner with a chargeability which is prepared by adding a charge control agent to the magnetic toner and by charging the toner in advance with a positive or negative polarity. This proposal is directed, as has been disclosed in Japanese Patent Laid-Open Nos. 55-48754, 57-45555, 57-45556 and 55-45557, to a method in which the magnetic toner is charged in advance for the development by adding a substance having a strong property as an electron acceptor or an electron donor to the inner and/or outer side of the magnetic toner.

If such charge control agent is added to the magnetic toner, this toner is charged by the frictional charging action between the toner particles, between the toner and the sleeve or between the toner and the doctor to achieve a charge substantially equal to that of the two-component system toner so that the photosensitive member can be developed under the condition where the surface potential of the photosensitive member is similar to that of the two-component system developer of the prior art. With the chargeable magnetic toner, however, the frictional chargeability of the toner particles is increased as the charge of the toner is improved, and the toner particles are liable to become charged and agglomerate on the sleeve so that the agglomerated toner deposits upon the toner regulating plate (i.e., the doctor blade) and forms streaks where development is incomplete due to a shortage of toner on the sleeve.

SUMMARY OF THE INVENTION

It is an object of the present invention to provide a method of electrophotography, which is freed from the aforementioned defects concomitant with the prior art and in which the toner is prevented from being charged and agglomerating, and especially when it is of chargeable magnetic toner excellent developability, thereby ensuring excellent developability and transferability and providing satisfactory copies.

The present invention has been conceived from the developing system of the magnetic toner of the prior art by the finding that, if semiconductive ferrite carriers are added to chargeable magnetic toner when the toner is to be developed, the clusters in the toner are broken by the mechanical force of the carriers, improving the fluidity of the toner so that the toner is prevented from being charged and agglomerating, thereby eliminating the white streaks due to insufficient development.

In the method of electrophotography according to the present invention, more specifically: an electrostatic latent image is formed on the surface of a substance layer; said electrostatic latent image is developed by a magnetic brush method using semiconductive ferrite carriers and chargeable magnetic toner; and the developed toner image is transferred to a transfer member and is then fixed.

DETAILED DESCRIPTION OF THE INVENTION

In the present invention, the ferrite carriers are specifically characterized as magnetic materials which are constructed of a thorough mixture of a suitable metal oxide and an iron oxide and which has a crystallographic structure such as a spinel, perovskite, hexagonal, garnet or orthoferrite structure. In other words, the ferrite carriers are made of a sintered material of an oxide of nickel, zinc, manganese, magnesium, copper, lithium, barium, vanadium, chromium or calcium and a trivalent iron oxide.

Such ferrite carriers are chemically more stable and less troubled by rust and have less charge in resistance while they are being used than the conventional carriers of iron oxide, which have their surfaces oxidized. Also, those ferrite carriers have less residual magnetization and better fludicity and agitatability. Moreover, the ferrite carriers have about two thirds of the specific gravity of the iron powder carriers and enjoy the advantage that they are so light as to require less torque for their movement. Furthermore, the ferrite carriers have longer lifetimes and do not exert a higher mechanical force upon the toner than necessary.

Figure 1:
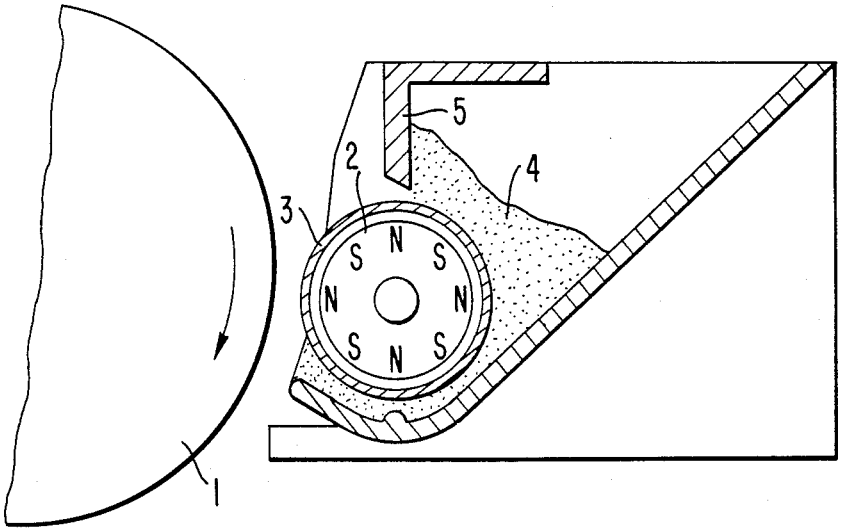
FIG. 1 is a sectional view of one embodiment of the developing device of the magnetic toner.

The semiconductive ferrite carriers thus specified can be applied as they are to the conventional developing system of the magnetic toner shown in FIG. 1, if they are added to the chargeable magnetic toner.

In FIG. 1, a non-magnetic cylinder (or sleeve) 3 is disposed to face a photosensitive member 1. In this sleeve 3, there is mounted a magnet roll which has a permanent magnet 2 having a plurality of symmetric magnetic poles extending in the axial direction. Reference numerals 4 and 5 appearing in the drawing indicate magnetic toner and a toner regulating plate, respectively. As the developing conditions of the developing device shown in FIG. 1, there can be enumerated the kind of the photosensitive member 1, the electric and magnetic characteristics of the toner 4, the gap between the photosensitive member 1 and the sleeve 3 (i.e., the developing gap), the gap between the sleeve 3 and the toner regulating plate 5 (i.e., the doctor gap), the direction and number of rotations of the sleeve 3, and the magnetic force and the direction and number of rotations of the roll of the magnet 2. The developing system is determined by making those conditions proper. For the ordinary chargeable magnetic toner, the developing gap and the doctor gap are generally restricted to within a range of 0.1 to 0.6 mm whereas the magnetic force of the magnet roll is generally within a range of 600 to 1,200 gausses.

Taking the above-specified conditions into consideration, the physical values of the ferrite carriers satisfying the conditions have been investigated. As a result, of these investigations, the most proper ferrite carriers have been found to be generally true spheres and to have a saturated magnetization of 20 to 90 emu/g, a Curie temperature no lower than 100° C., an intrinsic volume resistance of $10^3$to $10^{13}\Omega$·cm for a direct current of 100 V/cm, and a mean particle diameter of 10 to 100 μm.

In case the saturated magnetization of the ferrite carriers is lower than 20 emu/g, the carriers leave the sleeve while they are being moved, even if the magnetic force of the magnet roll is increased, and secure themselves to the surface of the photosensitive member, thereby forming defects in the resultant image. In case the saturated magnetization of the ferrite carriers is higher than 90 emu/g, the movement of the carriers by magnetic force is increased, and the mechanical force to be exerted upon the toner raised to where the toner is possibly crushed, losing its function.

On the other hand, since the developing gap and the doctor gap for the magnetic toner are about one tenth narrower than that in the case of the two-component system developer of the prior art, it is necessary to accordingly reduce the particle size of the carriers. If excessively small carriers are used, however, their function to prevent the toner from agglomerating is degraded, and the problem of carrier splash during the movement arises. For these points, the best carriers have a mean particle diameter of 10 to 100 μm.

Moreover, it is desired that the carriers be generally truly spherical. This shape enhances the fluidity and movement of the carriers and does not inflict more damage to the toner than necessary.

In the ordinary developing device using the magnetic toner, the doctor blade or the sleeve is made of a conductor, and electric means for releasing the excessive charge stored in the magnetic toner is provided to stabilize the development. When ferrite carriers are added to that developing system, the electric resistance of the carriers has to be dropped to prevent the electrode effect of the doctor blade or the sleeve from being degraded by the addition of the carriers. If, in this case, the intrinsic volume resistance of the carriers is kept within a range of $10^3$ to $10^{13}$ Ω·cm, the electrode effect by the carriers helps stabilize the development. As a result, the resin coating on the surface which is used in some carriers is not required.

In the present invention, the carriers are used to prevent the toner from being charged and agglomerating but are independent of the charge control of the magnetic toner. If the carriers dominate the charge control of the magnetic toner, toner control for always keeping the ratio of the two constant is required, thereby losing the intrinsic merit of magnetic toner. Therefore, the magnetic toner of the present invention is required to have a predetermined quantity of saturated charge independently of the carriers. For this requirement, a suitable magnetic toner is constructed to have an intrinsic volume resistance exceeding $10^{14}$ Ω·cm when an electric field of a direct current of 4,000 V/cm is applied, to be highly insulated, to have a specific inductivity lower than 3.0 for a frequency of 100 KHz, to contain a charge control agent, and have fine silica powder adhering to its surface.

Next, for the insulating chargeable magnetic toner thus far described, it is found that the best method for the developing system is conducted by rotating the sleeve and the magnet roll in opposite directions and by moving the magnetic toner at the developing section at a relatively high speed in the same direction as the photosensitive member. This is because the chargeable magnetic toner of the present invention has a large quantity of charge and such a characteristic as to be liable to be sticked to the photosensitive member. It is therefore thought that the aforementioned method is preferable in that it has a high cleaning efficiency simultaneously with the development.

The most proper movement system for the chargeable magnetic toner is obtained from the following experimental results.

Figure 2:
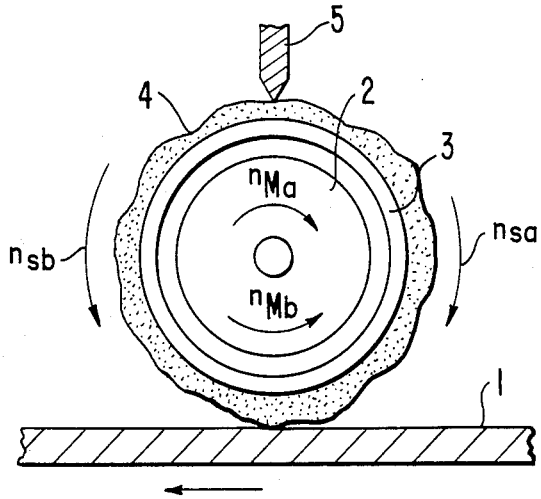
FIG. 2 is a schematic sectional view of the developing apparatus for explaining the method of the present invention.

First of all, the most proper toner movement method for the chargeable magnetic toner was sought for. As shown in FIG. 2, the magnet 2 of eight symmetric poles, which had a magnetic flux density of 1,000 gausses and a magnetizing width of 255 mm on a sleeve having an internal diameter of 29.3 mm and an external diameter of 31.4 mm, and the conductive sleeve 3, which was made of a non-magnetic material like stainless steel, were set to have a number of rotations ranging from 100 to 1,500 r.p.m. and 10 to 500 r.p.m., respectively. The gap at the developing section between the photosensitive member 1 and the sleeve 3 (i.e., the developing gap) and the gap for regulating the quantity of the magnetic toner 4 moved on the sleeve 3 by the doctor blade 5 (i.e., the doctor gap) were within ranges of 0.2 to 0.6 mm and 0.15 to 0.6 mm, respectively. The experiments were conducted by using the negative charge type magnetic toner which had an intrinsic volume resistance of $5\times10^{14}$ Ω·cm when an electric field of a direct current of 4,000 V/cm is applied, and a specific inductivity of 2.1 for a frequency of 100 KHz, by using a Se drum having an internal diameter of 120 mm as the photosensitive member 1, by setting the surface potential of the Se drum at +700 V, by grounding the conductive sleeve and the back of the Se drum to earth, and by moving the Se drum at a circumferential velocity of 120 mm/sec. The negative charge type magnetic toner used in the experiments was prepared by adding and mixing 0.3 wt. % of hydrophobic silica (e.g., Aerozil R 972 made by Nippon Aerozil KK) having a mean particle size of about 200 Å (Ångström) to and with the toner having a mean particle size of 15 μm, which in turn was prepared by adding 3 wt. % of a negative charge control agent (e.g., Bontrol E-81 made by Orient Kagaku KK) to 47 wt. % of a resin of copolymer (e.g., SBM 600 having a mean molecular weight of about 90,000 and made by Sanyo Kasei KK) of styrene and butyl methacrylate and 50 wt. % of magnetic powder (e.g., EPT-500 made by Toda Kogyo KK).

If the movement direction of the toner is taken into consideration in the aforementioned experiments, ten kinds of developing methods can be counted. The experimental results of the movement system are tabulated in Table 1.

TABLE 1

| | | $n_M$ Direction of Rotations of Magnet | | | | | |
|---|---|---|---|---|---|---|---|
| | | a | | Stop | | b | |
| | | Migration of Toner | | | | | |
| $n_S$ | | a | b | a | b | a | b |
| Direction | a | Δ | x | Δ | | ○ | |
| of Rotations | Stop | | x | | | Δ | |
| of Sleeve | b | | x | | x | Δ | x |

Note:
○ indicates excellent development;
Δ indicates inferior development with bad half-tone reproducibility; and
x indicates inferior development with high background density.

In Table 1, letters $n_M$ and $n_S$ indicates the r.p.m. of the magnet and the sleeve, respectively, and letters a and b indicate clockwise and counter-clockwise rotations, respectively. Incidentally, the photosensitive member moves from the right to the left of the drawing. From the experiments thus far described, the following items could be confirmed. First of all, in the case when only the sleeve rotates, the image takes a hard tone, and the toner tends to aggregate at the developing section, and the photosensitive member is liable to be damaged, but the migrating direction of the toner is preferred to be identical to that of the photosensitive member. Next, when the magnet alone rotates and the toner migrates in the same direction as that of the photosensitive member, a relatively excellent result is obtained, but the development becomes irregular for slow rotations, and the density does not become clear, and it is remarkably difficult to adjust the gaps. In the case where both the magnet and the sleeve are rotated, and especially when the movement direction of the toner in the developing section is also made identical to that of the photosensitive member, the best image can be obtained. In this case, no background occurs, and since the toner has its movement direction and its rotating direction identical to each other at the section contacting with the photosensitive member, the development and the cleaning of the toner are balanced to produce a very clear image.

In those experiments, we, the Inventors, have examined not only the rotating directions of the magnet roll and the sleeve but also their r.p.m. and have found that an image of high quality can be obtained when r.p.m. of the magnet roll is not lower than 700 r.p.m. and the r.p.m. of the sleeve is not lower than 200 r.p.m. It has also been found that the migrating velocity of the toner in this case is not lower than about 40 cm/sec if it is calculated by the method disclosed in Japanese Patent Laid-Open No. 55-126266, and that the toner has to be transferred at the higher velocity. It has further been found that the appropriate magnetic force for the magnet roll is within a range of 800 to 1,200 gauss, and that the developing gap and the doctor gap should be within the ranges expressed by the following general expressions:

$$\tfrac{1}{2}G \leqq Dg \leqq G - 0.05 \quad (1);$$

and $$0.3 \leqq G \leqq 0.6 \quad (2),$$

where:

G indicates the developing gap (mm); and

Dg indicates the doctor gap (mm).

With the developing system thus far described, the insulating negative chargeable magnetic toner could be developed to a satisfactory extent. It has, however, been found that because of the strong frictional chargeability, the toner is liable to be charged and to agglomerate, and that, in the aforementioned case, the toner having agglomerated deposits upon the doctor section to form streaks resulting from incomplete development on the sleeve due to shortage of the toner thereby forming defects in the image. From this the present invention was contemplated to eliminate the streaks due to incomplete development.

In FIG. 2, spherical ferrite carriers of Ba-Zn-Ni (e.g., KBN-100 made by Hitachi Kinzoku KK), which has a saturated magnetization of 50 emu/g, a Curie temperature of 425° C., an intrinsic volume resistance of $10^9\Omega$·cm for a direct current of 100 V/cm, and a mean particle diameter of 40 μm, was adhered within a range of 0.5 g to 15 g to a sleeve which had an external diameter of 31.4 mm, a surface density of magnetic flux of 1,000 gauss and a magnetizing width of 255 mm, and the sleeve thus prepared was covered with the ferrite carriers. After that, 10 g of magnetic toner was added to develop the photosensitive member. In this instance, the developing gap was set at 0.45 mm, and the doctor gap was set at 0.35 mm. The sleeve was rotated at 300 r.p.m. in the clockwise direction whereas the magnet roll was rotated at 1,000 r.p.m. in the counter-clockwise directions and the magnetic toner and the ferrite carriers were moved clockwise to effect development by the magnetic toner. The change in the density of the magnetic toner which stuck to the photosensitive member is plotted in FIG. 3 against the quantity of the ferrite carriers added.

Figure 3:
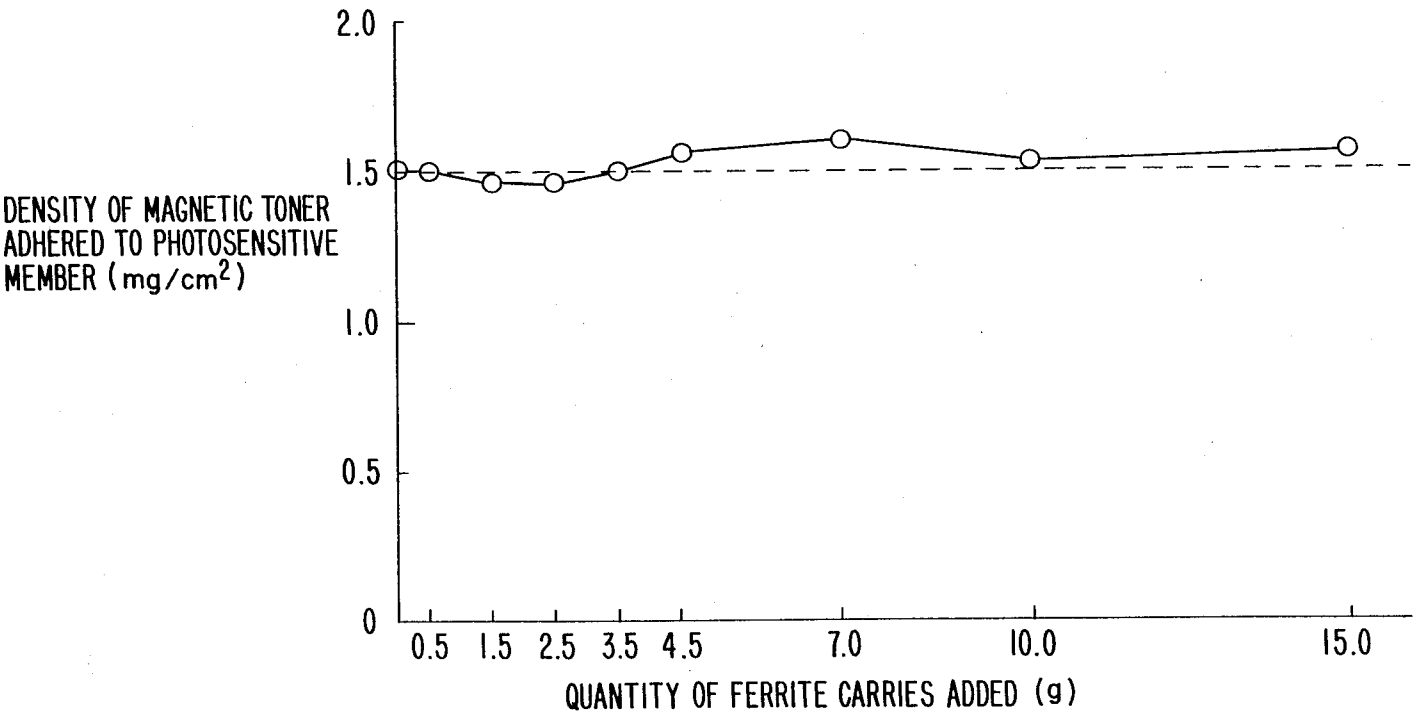
FIG. 3 is a graph illustrating the quantity of ferrite carriers added and the density of magnetic toner stuck to the photosensitive member.

In view of FIG. 3, it is understood that the density of the sticking magnetic toner is essentially constant irrespective of the quantity of the ferrite carriers added. It has also been found that the magnetic toner could be prevented from becoming charged and agglomerating by adding the ferrite carriers in advance to eliminate the streaks on the sleeve from in complete development due to the shortage of the toner so that a highly uniform, high quality image could be obtained. From the aforementioned experiments, it was also found that the quantity of the ferrite carriers added was effective if it was as high as several grams. It has been confirmed that the magnetic toner could be prevented from becoming charged and agglomerating by adding a small quantity of the ferrite carriers, and even by adding a large quantity of toner, so that a developer of long life-time having little image quality change could be obtained even after continuous copying operations. In the aforementioned experiments, moreover, the copied image could be obtained by transferring the toner image formed on the Se drum to the transfer paper by corona discharge and by subsequently conducting the heat roll fixing operation. Since, in this case, the electric insulation of the toner was high, there were no limits on the transfer paper, and ordinary paper having a low electric resistance could be used. Within the copying conditions thus far described, it was possible to continuously produce satisfactory copy images which were excellent in developability and transferability and which had no background but a sufficient image density.

The description thus far made on the method of electrophotography according to the present invention has been concentrated upon ordinary transfer type copying machines. It goes without saying that the method of electrophotography of the present invention can be applied to a variety of recording apparatus, in which an electrostatic latent image on an insulator or a photosensitive member is transferred, while being developed, to conduct the copying and recording operations, such as a printer or a facsimile in case the transferring step is required. In the present invention, moreover, the foregoing description has been directed to the case where the cylindrical non-magnetic sleeve and the permanent magnet roll are arranged rotatably in the non-magnetic sleeve and used as the means for movement of the toner. However, an electromagnet other than a permanent magnet roll may be used as the magnetic field generating means, or the two may be used together. It goes without saying that a similar effect can be obtained even by the combination of a belt-shaped non-magnetic carrier and the aforementioned magnetic field generating means having its alternating NS magnetic field moving in opposite direction as that of the non-magnetic carrier.

In the present invention, the magnetic characteristics of the ferrite carriers were measured by the use of a sample vibration type magnetometer (e.g., VSM-3 made by Toei Kogyo KK), and the intrinsic volume resistances of the ferrite carriers and the magnetic toner were computed by metering small quantities of samples (i.e., several 10 mg of the carriers and 10 and several mg of the toner), by inserting the metered samples into an insulating cylinder of polyacetal with a diameter of 3.05 mm (i.e., an effective sectional area of 0.073 $cm^2$) made by improving a dial gauge, by measuring the resistance of the carriers in an electric field of 100 $V/cm^{-1}$ and under a load of 0.1 kg wt., and by measuring the resistance of the toner in an electric field of 4,000 $V/cm^{-1}$. For the measurements, the insulating ohm meter of 4329A type made by Yokokawa - Hewlett Packard KK was used. On the other hand, the specific inductivity of the toner was measured by using a Q meter. A cylindrical cell with an internal diameter of 42 mm was used and had its bottom covered with a conductor to provide an electrode. The side of the cell was covered with an insulator of polyacetal with a thickness of 3 mm and a height of 5 mm. The specific inductivity of the toner was measured by metering and taking 3 to 5 g of the magnetic toner into the cell, by sandwiching the metered toner between the two opposed disc electrodes of the Q meter, and by using a frequency of 100 KHz. The Q meter used was a QM-102 A made by Yokokawa Electric KK.

The present invention will be described in more detail in the following in connection with the embodiments thereof, by which its scope should not be limited.

EMBODIMENTS OF THE INVENTION

Example 1

A Se drum having an external diameter of 120 mm was used as the photosensitive member. Spherical ferrite carriers were used (e.g., the ferrite carriers KBN-100 of Ba-Zn-Ni made by Hitachi Kinzoku KK), which had a saturated magnetization of 60 emu/g, a Curie temperature of 425° C., an intrinsic volume resistance of $10^9\Omega\cdot$cm for a direct current of 100 V/cm, and a mean particle diameter of 40 μm, and negative chargeable magnetic toner with an intrinsic volume resistance of $5\times10^{14}\Omega\cdot$cm for a direct current of 4,000 V/cm, and a specific inductivity of 2.3 for a frequency of 100 KHz. Moreover, the electrostatic latent image, which was prepared by the reflection exposure of a visible light source and which had a surface potential of +650 V, was developed by the use of the developing device shown in FIG. 1. The negative chargeable magnetic toner used was prepared by adding and mixing 0.3% by wt. of fine hydrophobic silica powder (e.g., Aerozil R972 made by Nippon Aerosil KK) to a toner with a mean particle diameter of 18 μm, prepared by adding 2% by wt. of a negative charge control agent (e.g., Bontrol E-81 made by Orient Kagaku KK) to 48% by wt. of a copolymer (e.g., Plyorite S-5B made by Goodyear KK) of styrene and butadiene and 50% by wt. of magnetic powder (e.g., EPT-500 Toda Kogyo KK).

The circumferential velocity of the Se drum was 150 mm/sec. In the developing device, a stainless steel sleeve with an external diameter of 32 mm was rotated at 300 r.p.m. The magnet roll, which had a magnetic force of 1,000 gauss on the sleeve surface, a magnetizing width of 255 mm and eight symmetric magnetic poles, was rotated at 1,000 r.p.m. The developing gap and the doctor gap were set at 0.4 mm and 0.2 mm respectively. The sleeve and the magnet roll were rotating such that, at the developing section, the sleeve was rotated in the direction opposite the Se drum whereas the magnet roll was rotated in the same direction as the Se drum. The sleeve and the back of the Se drum were grounded to earth. After 7 g of the ferrite carriers were metered and adhered to the sleeve, the magnetic toner was supplied to develop the electrostatic latent image on the Se drum. The toner image obtained after the development was transferred to ordinary paper by corona discharge, and the heat roll fixture was then conducted to obtain the copy image.

Under the above copying conditions, the developability and transferability of the magnetic toner provided an excellent copy image with no background but sufficient image density.

Example 2

A Se-Te drum being sensitive at long wavelength and having an external diameter of 120 mm was used as the photosensitive member. A positive charge type magnetic toner with an intrinsic volume resistance of $10^{15}$ $\Omega\cdot$cm for a direct current current of 4,000 V/cm and a specific inductivity of 2.1 for a frequency of 100 KHz was used. Then, the electrostatic latent image, which was prepared to have a surface potential of 700 V by the divided exposure of a semiconductor laser (e.g., HL-1400 with an oscillatory wavelength of 780 nm and an output of 5 mW by Hitachi Seisakusho KK), was reversely developed by the use of ferrite carriers and developing device similar to those of Example 1. The positive chargeable magnetic toner used was prepared by adding and mixing 0.3% by wt. of fine powder of hydrophobic silica (e.g., Aerosil R972 made by Nippon Aerozil KK) to a toner with a mean particle diameter of 15 μm, prepared with 3% by wt. of a positive charge control agent (e.g., Bontron N-01 made by Orient Kagaku KK), 47% by wt. of copolymer (e.g., SBM700 made by Sanyo Kasei KK) of styrene and butyl methacrylate, and 50% by wt. of magnetic powder (e.g., KN-320 made by Toda Kogyo KK).

The circumferential velocity of the Se-Te drum was 100 mm/sec. In the developing apparatus, a positive bias voltage of +650 V was applied between the sleeve and the back of the Se-Te drum with the sleeve being held at the positive potential, and the reversal development was conducted by the identical method as Example 1. The toner image thus formed on the Se-Te drum was transferred to ordinary paper by corona discharge, and the heat roll fixture was then conducted. As a result, a print image excellent in both developability and transferability, and with no background but sufficient density, was produced.

Example 3

As the photosensitive member, there was used a two-layered organic photosensitive drum (in which: the charge generating layer was made of metal-free phthalocyanine pigment; and the charge transferring layer was made of a system of a derivative of oxazole and a polyester resin) which had a sensitivity from a visible range (400 to 650 μm) to a long wavelength and an external diameter of 120 mm. Then, the electrostatic latent image, which was prepared to have a surface potential of −650 V by the reflection exposure of a visible light source, was developed by a developing device similar to that of Example 1. In this case, the ferrite carriers and the positive chargeable magnetic toner of Example 2 were used.

The circumferential velocity of the organic photosensitive drum was 150 mm/sec. The sleeve and magnet roll used were similar to those of Embodiment 1 and were rotated in the same directions and at similar rotational velocities as those of Embodiment 1. The developing gap and the doctor gap were set at 0.45 mm and 0.35 mm respectively.

The toner image thus formed on the organic photosensitive drum was transferred to ordinary paper by corona discharge, and the heat roll fixture was then conducted. As a result, a copy image, with excellent developability and transferability and with no background but sufficient density, was produced.

Example 4

As the photosensitive element, there was used an organic photosensitive drum similar to that of Example 3. The ferrite carriers and the negative chargeable magnetic toner of Example 1 were used. Then, the electrostatic latent image, prepared to have a surface potential of −700 V by the divided exposure of a semiconductor laser, was reversely developed by a developing device similar to that of Example 2.

The circumferential velocity of the organic photosensitive drum was 100 mm/sec. In the developing device, a bias voltage of −650 V was applied between the sleeve and the back of the organic photosensitive drum with the sleeve being held at negative potential, and the reversal development was conducted by the same method as in Example 3. The toner image thus formed on the organic photosensitive drum was transferred to ordinary paper by corona discharge, and the heat roll fixture was then conducted. As a result, a print image, with excellent developability and transferability and with no background but sufficient density, was produced.

Example 5

As the photosensitive member, there was used a member with an external diameter of 160 mm and prepared by covering CdS with Mylar. The ferrite carriers and the negative chargeable magnetic toner of Example 1 were used. Then, the electrostatic latent image, which was prepared to have a surface potential of +600 V by the reflection exposure of a visible light source, was developed by the use of a developing device similar to that of Example 1. The circumferential velocity of the photosensitive member was 86 mm/sec. A sleeve similar to that of Example 1 was rotated at 400 r.p.m. The magnet roll, which had a magnetic force of 800 gauss on the surface of the sleeve and eight symmetric magnetic poles, was rotated at 1,300 r.p.m. The developing gap and the doctor gap were set at 0.3 mm and 0.15 mm respectively. Incidentally, the rotating directions of the photosensitive member, the sleeve and the magnet roll were those of Example 1.

The toner thus formed on the photosensitive member was transferred to ordinary paper by corona discharge, and the heat roll fixture was then conducted. As a result, a copy image with excellent developability and transferability and with no background but sufficient density, was produced.

Example 6

As the photosensitive member, there was used ZnO master paper with an external diameter of 210 mm. The ferrite carriers and the positive chargeable magnetic toner of Example 2 were used. Then, the electrostatic latent image, which was prepared to have a surface potential of −450 V by the reflection exposure of a visible light source, was developed by a developing device similar to that of Example 1. The circumferential velocity of the photosensitive member was 65 mm/sec. A sleeve similar to that of Example 1 was rotated at 350 r.p.m. The magnet roll, which had a magnetic force of 1,200 gauss on the surface of the sleeve and eight symmetric magnetic poles, was rotated at 1,400 r.p.m. The developing gap and the doctor gap were set at 0.5 mm and 0.3 mm respectively. Incidentally, the rotating directions of the photosensitive member, the sleeve and the magnet roll were the same as in Example 1.

The toner image thus formed on the photosensitive member was transferred to ordinary paper by corona discharge, and the heat roll fixture was then conducted. As a result, a copy image, with excellent developability and transferability and with no background but sufficient density, was produced.

According to the present invention, the fluidity of chargeable magnetic toner, which had been insufficient in the prior art, can be much improved to prevent the toner from being charged and agglomerating. This makes it possible to expect a remarkable improvement in the image quality of a normal or reversal developing system using a variety of photosensitive members and to reduce the sizes of an enhance the performances of a variety of copying machines, printers or facsimiles using the technique of electrophotography.

What we claim:

1. A method of electrophotography characterized: in that an electrostatic latent image is formed on the surface of a substance layer; in that said electrostatic latent image is developed by a magnetic brush method using semiconductive ferrite carriers and triboeletric magnetic toner with a chargeability to provide the magnetic brush, the ferrite carriers having a saturated magnetization of 20 to 90 emu/g and the magnetic toner having an intrinsic volume resistance exceeding $10^{14}$ Ω·cm when an electric field of a direct current of 4,000 V/cm is applied, with the magnetic brush moving at high speeds and in the same direction relative to the substance layer;

and in that the developed toner image is transferred to a transfer member and then fixed.

2. A method of electrophotography as set forth in claim 1, characterized: in that a non-magnetic cylinder is disposed to face the surface of said substance layer; in that there is mounted in said cylinder a magnet roll which has a plurality of symmetric magnetic poles extending in the axial direction; and in that said semiconductive ferrite carriers and said chargeable magnetic toner are attracted onto said non-magnetic cylinder by the magnetic attraction of said magnet roll thereby forming a magnetic brush.

3. A method of electrophotography as set forth in claim 2, characterized in that said magnet roll is a permanent magnet roll.

4. A method of electrophotography as set forth in claim 2, characterized in that said non-magnetic cylinder and said magnet roll are moved in opposite directions.

5. A method of electrophotography as set forth in claim 2, characterized: in that said non-magnetic cylinder is at least in part immersed in a toner container containing said magnetic toner; and in that there is used a developing device which has such a construction that the magnetic attraction of said magnet roll is applied directly to the magnetic toner in said toner container.

6. A method of electrophotography as set forth in claim 2, characterized: in that said non-magnetic cylinder is made of a conductor and/or is replaced by a conductive section which is in contact with said ferrite carriers and said magnetic toner; and in that there is provided electric means for releasing the excess charges, which are stored in the ferrite carriers and the magnetic toner left undeveloped on said non-magnetic cylinder during the development, to electrically neutralize the mixed system of said ferrite carriers and said magnetic toner.

7. A method of electrophotography as set forth in claim 6, characterized in that grounding means electrically connected with the back of said substance layer is used as said electric means.

8. A method of electrophotography as set forth in claim 2, characterized in that a conductive cylinder is used as said non-magnetic cylinder, and a bias voltage between said conductive cylinder and the back of said substance layer is applied to apparently reverse said electrostatic latent image and to stick said magnetic toner to the uncharged section of said substance layer.

9. A method of electrophotography as set forth in any one of the claims 1 to 8, characterized in that said ferrite carriers used are of generally spherical shape and have a Curie temperature not lower than 100° C., an intrinsic volume reistance of $10^3$ to $10^{13}$ Ω·cm for a direct current of 100 V/cm, and a mean particle diameter of 10 to 100 μm.

10. A method of electrophotography as set forth in any one of the claims 1 to 8, characterized in that said chargeable magnetic toner is so constructed as to have a specific inductivity lower than 3.0 for a frequency of 100 KHz, a charge control agent in the inside thereof, and fine silica powder adhered to the outside thereof.

11. A method of electrophotography as set forth in claim 1, wherein the ferrite carriers are made of a sintered material of at least one oxide selected from the group consisting of nickel oxide, zinc oxide, manganese oxide, magnesium oxide, copper oxide, lithium oxide, barium oxide, vanadium oxide, chromium oxide and calcium oxide, and a trivalent iron oxide.

12. A method of electrophotography as set forth in claim 2, wherein the gap between the surface of said substance layer and said cylinder is 0.1 mm to 0.6 mm.

13. A method of electrophotography as set forth in claim 2, wherein the magnet roll has a magnetic force within a range of 600 to 1,200 gauss.

14. A method of electrophotography as set forth in claim 13, wherein the magnet roll has a magnetic force within a range of 800 to 1,200 gauss.

* * * * *